United States Patent [19]

Muscarello

[11] Patent Number: 4,721,264

[45] Date of Patent: Jan. 26, 1988

[54] CHILD-PROOF TOILET TISSUE DISPENSER

[76] Inventor: Giovanna F. Muscarello, 1865 E. Fountain St., Mesa, Ariz. 85203

[21] Appl. No.: 62,843

[22] Filed: Jun. 15, 1987

[51] Int. Cl.[4] ..... B65H 19/00; B65D 85/66

[52] U.S. Cl. ..... 242/55.53; 206/390

[58] Field of Search ..... 242/55.2, 55.53; 206/390, 407, 408, 397, 403; 220/252, 345; 312/38–41, 37; D6/518, 521–523; 222/559–561; 221/45, 282

[56] References Cited

U.S. PATENT DOCUMENTS

| | | | |
|---|---|---|---|
| 2,561,584 | 7/1951 | McDonald | 242/55.53 X |
| 2,649,255 | 8/1953 | Smallen | 242/55.53 X |
| 4,114,824 | 9/1978 | Danielak | 242/55.53 |

*Primary Examiner*—David Werner

*Attorney, Agent, or Firm*—James H. Phillips

[57] ABSTRACT

An accessory for a conventional toilet tissue roll holder and an integrated dispensing assembly operating on the same principal is disclosed, each adapted to prevent unauthorized access to a toilet tissue roll by a child who might unroll the tissue in an uncontrolled manner. The accessory includes a stationary component in the form of an incomplete cylinder and having a coupling region which is rectangular and flattened and includes a pair of spaced apart elongated apertures. The first component also has a pair of circumferentially extending guides disposed proximate its ends. A movable component is also generally in the form of an incomplete cylinder and includes first and second circumferentially flanges with the respective distances between the guides and the flanges such as to permit them to slideable cooperate in a manner which permits rotation of the second component coaxially within the first component between alternative protected (closed) and unprotected (open) positions. Securement apparatus for detachably fixing the second component in the protected position is provided. The integral dispensing assembly counterpart further includes, with the stationary component, a rectangular coupling region peripherally extending about the stationary component to permit affixing the assembly to the recessed within a wall.

4 Claims, 12 Drawing Figures

FIG. 1
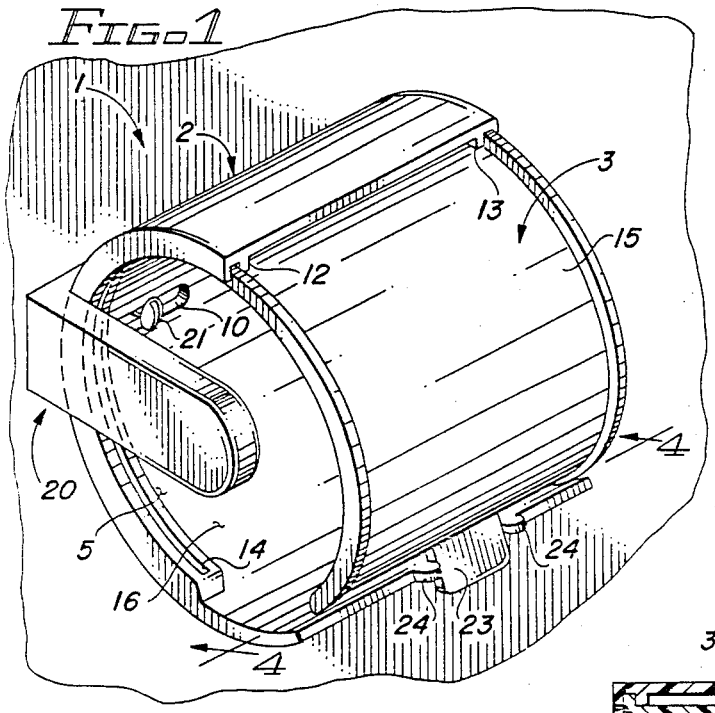
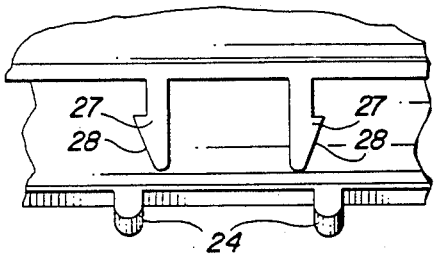
FIG. 5
FIG. 3
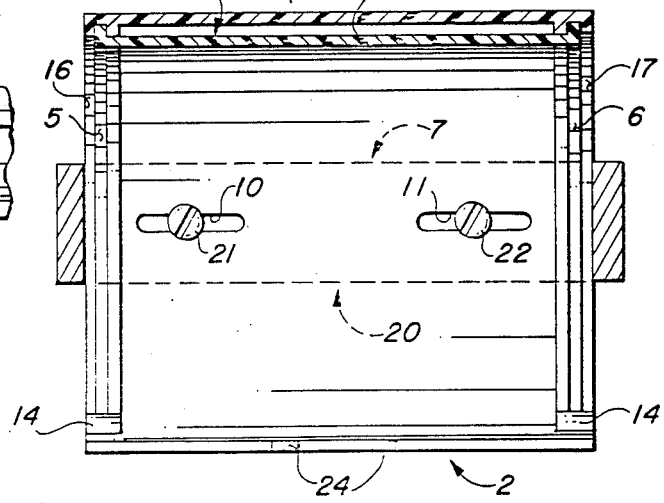
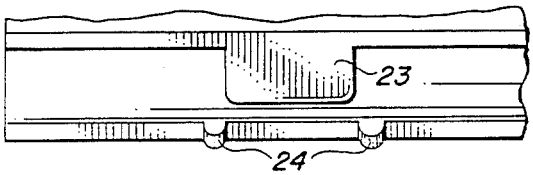
FIG. 4
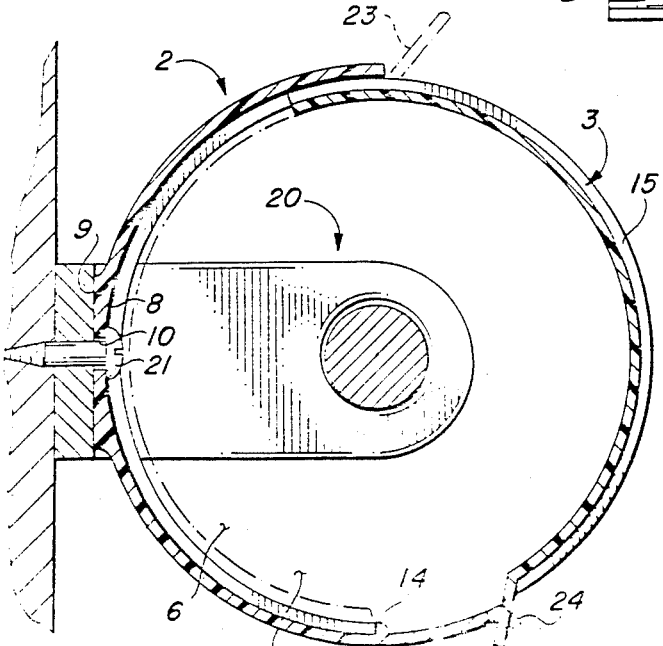
FIG. 2
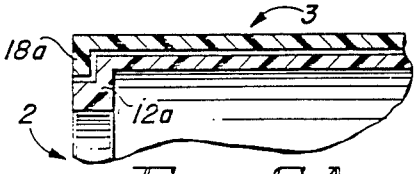
FIG. 6A
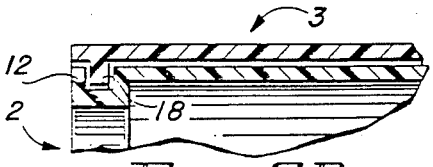
FIG. 6B
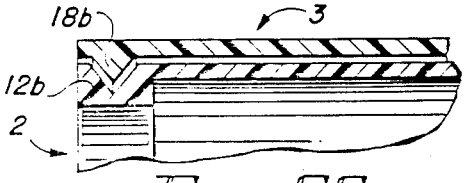
FIG. 6C

CHILD-PROOF TOILET TISSUE DISPENSER

FIELD OF THE INVENTION

This invention relates to the dispensing arts and, more particularly, to a toilet tissue dispenser with controlled access features.

BACKGROUND OF THE INVENTION

Most parents of small children, at one time or another, have experienced the problem of a curious child who, often repeatedly, pulls much or all the toilet tissue off a conventionally suspended roller. The consequence is threefold: the toilet tissue is essentially lost for use and must simply be discarded; a very considerable mess is made; and the child, often fascinated by the results, will be reinforced to undertake a repeat performance.

Thus, those skilled in the art will appreciate that it would be highly desirable to provide both an accessory fixture for integrating with conventional toilet tissue dispensing apparatus and an integral toilet tissue dispensing assembly, both working on the same principal by which this problem will be eliminated without undue inconvenicence to persons other than the child. It is to these ends that my invention is directed.

OBJECTS OF THE INVENTION

Therefore, it is a broad object of my invention to provide an improved toilet tissue dispensing assembly.

In a first specific aspect, it is an object of my invention to provide an accessory for integrating with conventional toilet tissue dispensing apparatus to provide a child-proof toilet tissue dispensing system.

In a second specific aspect, it is an object of my invention to provide a toilet tissue dispensing assembly operating on the same principals as the aforementioned accessory and which may be used to replace conventional toilet tissue dispensing apparatus.

It is a still more specific object of my invention to provide such apparatus in which the entire outer circumference of a toilet tissue roll is covered and secured between authorized uses in such a manner that a small child cannot access the roll while others may easily achieve such access.

SUMMARY OF THE INVENTION

Briefly, these and other objects of my invention are achieved by an accessory for a conventional toilet tissue roll holder and by an integrated dispensing assembly operating on the same principal. The accessory includes a first, stationary component generally in the form of an incomplete cylinder extending between one-half and five-eights of a full circle, the first component further including a coupling region situated intermediate its circumferential reach, the coupling region being rectangular and flattened on a rear face and having a pair of spaced apart, elongated apertures disposed in alignment with one another and generally parallel to the axis of the first component. The first component also includes a pair of circumferentially extending, inwardly directed guides disposed proximate the first component ends. A second, movable component cooperates with the first component and is also generally in the form of an incomplete cylinder having first and second open ends. The second component extends approximately one-half of a full circle and also includes first and second circumferentially extending, outwardly directed flanges with the respective distances between the guides and the flanges such as to permit the flanges to slideable cooperate with the guides in a manner which permits rotation of the second component coaxially with the first component between alternative protected (closed) and unprotected (open) positions. The accessory may be emplaced over a standard wall mounted toilet tissue holder by removing the screws holding the same, positioning the accessory with the apertures over the holder and thereafter replacing screws. Preferably, securement apparatus for detachably fixing the second component in the protected position may be provided and may operate either under frictional engagement or positive locking principals.

The integral dispensing assembly counterpart further includes, with the first, stationary component, an outwardly directed rectangular coupling region peripherally extending about the stationary component to permit affixing the assembly to and recessed within a wall.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a perspective view of an accessory version of my invention which is adapted for ready integration with a conventional toilet tissue dispenser;

FIG. 2 is a cross sectional view taken along the lines 2—2 of FIG. 1 to illustrate the relationship between stationary and movable components of the accessory and also the manner in which the entire assembly may be affixed to a wall;

FIG. 3 is a cross sectional view taken along the lines 3—3 of FIG. 1 and illustrates certain aspects of a coupling region of the accessory;

FIG. 4 illustrates a friction fit securement feature for holding the accessory in a protected position;

FIG. 5 shows an alternative, positive engagement securement features;

Figure 10:
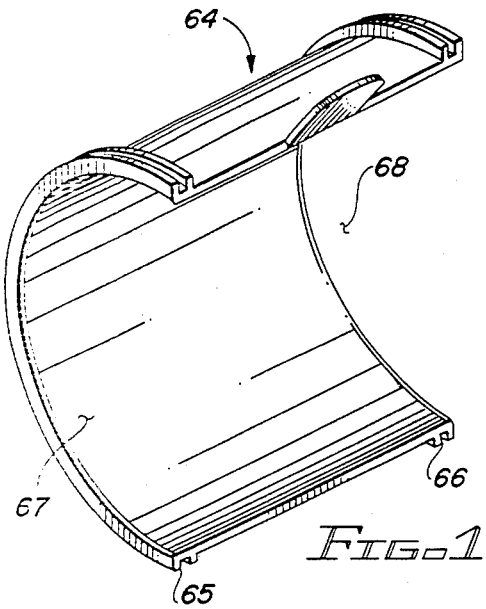
Figure 7:
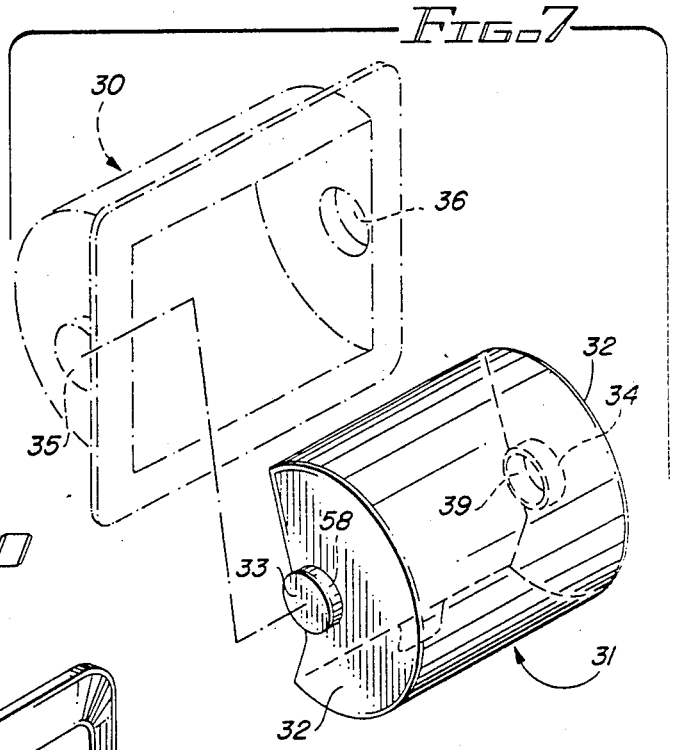
Figure 8:
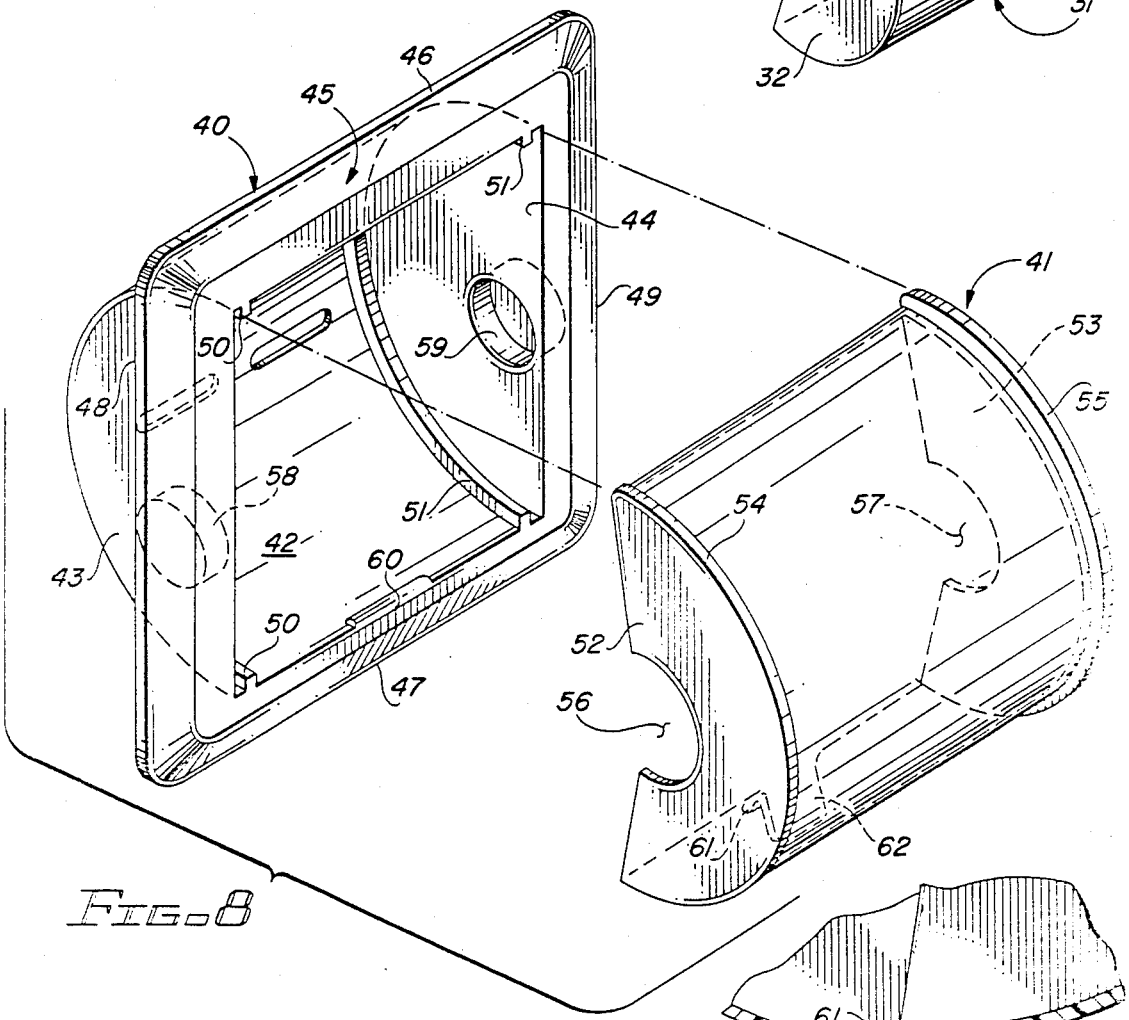
Figure 9:
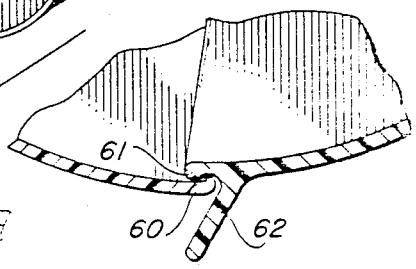

FIG. *6a, 6b,* and *6c* illustrate alternative configurations for coupling the movable and stationary components of the accessory in such a manner as to permit coaxial rotation between them;

FIG. 7 is a partially exploded view illustrating a version of my invention which can be incorporated into a conventional recessed toilet tissue dispensing apparatus;

FIG. 8 is an exploded view showing a version of my toilet tissue dispensing apparatus which constitutes a complete assembly for replacing a conventional recessed toilet tissue dispensing assembly;

FIG. 9 illustrates an alternative, open sided movable component configuration which may be employed in the complete assembly illustrated in FIG. 8; and FIG. 10 is a partial cross sectional view illustrating one version of a securement feature which may be included in the fully integrated embodiment of my invention.

DETAILED DESCRIPTION OF THE INVENTION

Referring now to FIGS. 1, 2 and 3, there is shown an accessory version of the subject invention which is particularly characterized by the fact that it can be incorporated with a conventional toilet tissue dispensing fixture during the period in which a child is being taught to refrain from indiscriminately unrolling the toilet tissue. The accessory 1 includes, as the principal components, a first, stationary component 2 and second, movable component 3. The first component 2 is generally in the form of an incomplete cylinder 4 having first and second open ends 5, 6. Thus, the first component 2 has an arcuate cross sectional configuration, best shown in FIG. 2, comprehending the range between one-half and five-eights of a full circle. As best shown in FIGS. 2 and 3, the first component also includes a coupling region 7 situated intermediate the circumferential reach of the incomplete cylinder and disposed generally parallel to its axis. The coupling region 7 is elongated and flattened on its rear face 9 to provide parallel inside and outside faces 8, 9, respectively. A pair of spaced apart elongated apertures 10, 11 extend between the inside and outside faces 8, 9 of the coupling region 7 and are disposed in alignment with one another and generally parallel to the axis of the first component 2.

Referring to FIG. 6*b*, as well as to FIG. 1, first and second circumferentially extending, inwardly directed guides 12, 13 in the form of channels are disposed proximate the respective first and second open ends 5, 6 of the first component.

The second, movable component 3 is also in the form of an incomplete cylinder 15 and also has first and second open ends, 16, 17 respectively. The cylinder 16 also has an arcuate cross sectional configuration and comprehends approximately one-half of a full circle. In addition, (and also referring to FIG. 6*b*), the second component 3 further includes the first and second circumferentially extending, outwardly extending flanges 18, 19 disposed proximate the open ends of the second component. The respective distances between the guides 12, 13 and the flanges 18, 19 are such as to permit the flanges to slideable cooperate, respectively with the guides. Referring briefly to FIGS. 6*a* and 6*c*, alternative configurations for the flanges and guides are identified as 12*a* and 18*a*, 12*b* and 18*b*. More particularly, the flange 18*a* is disposed at the very end of the second component 3, and the guide 12*a* is correspondingly dimensioned and configured. As shown in FIG. 6*c*, the flange 18*b* is triangular in cross section and again, the guide 12*b* is complementarily configured to receive the flanges in slideable cooperation.

Referring particularly to FIGS. 2 and 3, the manner in which the accessory 1 may be temporarily or permanently integrated with a standard toilet tissue roll holder 20 may be appreciated. The screws 21, 22 are removed and accessory 1 is then positioned over the holder 20 with the elongated apertures 10, 11 aligned with the holes previously made by the screws 21, 22 in the wall. Then, the screws 21, 22 (or longer counterparts if necessary) are reinserted and driven home to complete the process.

In operation, it will be readily apparent that the circumferential portion of a toilet tissue roll supported on the holder 20 cannot be accessed by a curious child when the second component 3 is in the closed, protected position illustrated in FIGS. 1 and 3. However, the roll may be readily accessed by an authorized person simply by lifting the tab 23 to permit the second component to rotate coaxially within the first component 2 to an unprotected open position at which the tab 23 will be in the position indicated in phantom in FIG. 3. It has been found that, preferably, another level of protection should be incorporated to prevent an especially observant child from simply imitating the actions of the authorized users by lifting the second component 3 to the roll accessible position. Thus, as shown in FIG. 4, the tab 23, in the closed, protected position, preferably frictionally engages the nibs 24 placed at the bottom open edge of the first component 2. Alternatively, as shown in FIG. 5, a still further degree of security may be achieved by the provision of a positive engagement securement feature including, on the lower lip edge of the second component 3, a pair of spaced apart, flexible latch members 27 which engage catches 24 provided at the lower edge of the first component 2. Thus, because of the slanted outboard sides 28 of the latch members 27, a positive engagement is achieved when the second component 3 is pushed fully to the protected position such that it can thereafter only be released by squeezing together the latch members 27 and simultaneously lifting up.

The open ended configuration for the accessory 1 permits the amount of remaining tissue on a roll to be determined, and the roll changed if necessary, without lifting the second component 3. Further, there is a distinct advantage from this configuration in simplicity of fabricating the accessory. Still further, assembly of the accessory is easier since the second component can be temporarily compressed.

FIG. 7 illustrates a simple variant embodiment of the subject invention which can be temporarily or permanently added to a recessed toilet tissue dispenser 30 already in place. In this embodiment of the invention, a single component 31 is in the form of an incomplete cylinder extending on the order of nine-sixteenths to five-eights of a full circle and having end walls 32. Coaxially with the incomplete cylinder 31, there is fitted, at each end, bearing members 33, 34 which are dismensioned to be received within journal regions 35, 36 of the conventional recessed dispenser 30. The end walls 32 of the incomplete cylinder 31 are relatively thin and sufficiently flexible to permit pressing them inwardly to insert the cylinder 31 within the fixture 30 whereupon, when the end walls 32 are released, the bearing members 33, 34 spring into the journals 35, 36. Then, with the incomplete cylinder 31 rotated to the fully open position, a roll of toilet tissue, inserted over its spring bar (not shown), may be mounted in the usual way such that the spring bar ends fit into the inwardly directed open ends 38, 39 of the bearing members 33, 34. Thereafter, the incomplete cylinder 31 may be raised and lowered between protected and unprotected positions as previously described.

In alternative embodiments, the subject invention may be provided in the form of a complete toilet tissue dispensing assembly rather than as an accessory to an existing toilet tissue holder, the principal of operation, however, being identical. Thus, referring to FIG. 8, there is shown a first, stationary component 40 and a second, movable component 41 which correspond generally to the components 2, 3 previously described for the accessory embodiment of the invention. The first, stationary component 40 has a central portion 42 generally in the form of a first incomplete cylinder having first and second ends 43, 44, respectively, and having an arcuate cross sectional configuration comprehending approximately one-half of a full circle. The first component 40 also has an outwardly directed rectangular coupling region 45 extending about the open edges of the incomplete cylinder 42 with upper and lower edges, 46, 47 disposed parallel to the axis of the incomplete cylinder 42 and first and second side edges 48, 49 disposed perpendicularly to the incomplete cylinder axis and passing therethrough. The incomplete cylinder 42 carries first and second circumferentially extending, inwardly directed guides 50, 51 disposed proximate the respective ends 43, 44 of the incomplete cylinder.

The second, movable component 41 is also generally in the form of an incomplete cylinder having first and second ends 52, 53. The second component 41 thus also has an arcuate cross sectional configuration which extends between the range of one-half and five-eighths of a full circle. In addition, the second component carries first and second circumferentially extending, outwardly directed flanges 54, 55 disposed proximate the respective first and second ends 52, 53 of the second component 41. Centrally disposed cut-outs 56, 57 are provided in each of the end walls 52, 53 for reasons which will become more apparent below.

The respective distances between the guides 50, 51 and flanges 54, 55 are such as to permit the flanges to slideable cooperate with the guides to effect an assembly in which the second component 41 is rotatable within the central portion 42 of the first component 40 between alternative protected, closed, and unprotected, open positions as previously described with respect to the accessory embodiments of the invention.

Disposed within the first component 40 and extending inwardly from its respective end walls 43 and 44 are journal members 58, 59 for receiving the ends of a conventional spring bar toilet tissue roll support member (not shown). The cut-outs 56, 57 in the second component 41 are positioned and dimensioned to provide clearance between the end walls 52, 53 of the second component 41 and the toilet tissue roll support member. It will be noted that, while the incomplete cylinder portion 42 of the first component 40 and the second component 41 are coaxial, a toilet tissue roll supported in the journals having a spring bar supported in the journal members 58, 59 is slightly offset to the rear and is therefore not coaxial.

As with the accessory embodiment of the invention previously discussed, it is desirable to provide a positive securement of the second component 41 when it has been rotated to the closed, protected position. Referring to both FIGS. 8 and 9, this may be achieved by cooperating resilient lips 60, 61 molded into the respective lower edges of the central portion 42 of the first component 40 and the second component 41. A tab 62, when pulled more or less tangentially away from the engaging lips 60, 61, permits ready access by an authorized user while preventing the assembly from being opened by a small child.

FIG. 10 illustrates a variant second component 64 which can be employed in place of the second component 41 illustrated in FIG. 8, the essential difference being in the provision of female channels 65, 66 in place of the flanges 54, 55 to couple with the guides 50, 51. In addition, it will be observed that the alternative second component 64 has open ends 67, 68 which is a presently preferred configuration because it permits flexure of the second component during assembly into the first component and also permits the remaining toilet tissue roll to be visually observed to determine if it should be changed. In addition, as previously noted, the open-ended version is simpler to fabricate.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

I claim:

1. An accessory for a conventional toilet tissue roll holder comprising:

(A) a first, stationary component, said first component being generally in the form of an incomplete cylinder and having first and second open ends, said first component having an arcuate cross sectional configuration comprehending the range between one-half and five-eights of a full circle, said first component further including:

1. a coupling region situated intermediate the circumferential reach of said stationary component and disposed generally parallel to the axis thereof, said coupling region having inside and outside faces and:
   a. being elongated and flattened on said outside face thereof;
   b. having a pair of spaced apart elongated apertures between said inside and outside faces, said apertures being disposed in alignment with one another and generally parallel to the axis of said first component;
2. a first circumferentially extending, inwardly directed guide disposed proximate said first open end of said first component;
3. a second circumferentially extending, inwardly directed guide disposed proximate said second open end of said first component;

(B) a second, movable component, said second component being generally in the form of an incomplete cylinder and having first and second open ends, said second component having an arcuate cross sectional configuration comprehending approximately one-half of a full circle, said second component further including:

1. a first circumferentially extending, outwardly directed flange disposed proximate said first open end of said second component;
2. a second circumferentially extending, outwardly directed flange disposed proximate said second open end of said second component;

(C) the respective distances between said guides and between said flanges being such as to permit said first and second flanges to slideably cooperate, respectively, with said first and second guides;

whereby, said accessory may be emplaced over a standard wall-mounted toilet tissue holder by removing the screws holding the same, positioning said accessory over the holder with said apertures over the screw holes in the wall and replacing the screws, said first and second flanges being captured by said first and second guides to permit rotation of said second component coaxially within said first component between alternative protected, closed and unprotected, open positions, the protected position preventing toilet tissue to be withdrawn from its roll and the unprotected position permitting toilet tissue to be withdrawn from its roll.

2. The accessory of claim 1 which further includes securement means for detachably fixing said second component in the protected position.

3. The accessory of claim 2 in which said securement means includes frictional engagement means cooperating between said first and second components.

4. The accessory of claim 2 in which said securement means includes releasable positive engagement means cooperating between said first and second components.

* * * * *